US007931484B2

(12) United States Patent
Chen

(10) Patent No.: US 7,931,484 B2
(45) Date of Patent: Apr. 26, 2011

(54) LATCHABLE POWER OUTLET

(76) Inventor: Chi Wen Chen, Yonghe (TW)

( * ) Notice: Subject to any disclaimer, the term of this patent is extended or adjusted under 35 U.S.C. 154(b) by 0 days.

(21) Appl. No.: 12/699,875

(22) Filed: Feb. 3, 2010

(65) Prior Publication Data

US 2010/0197156 A1 Aug. 5, 2010

(30) Foreign Application Priority Data

Feb. 4, 2009 (TW) ..... 98201627 U

(51) Int. Cl.
*H01R 29/00* (2006.01)

(52) U.S. Cl. ..... 439/188

(58) Field of Classification Search ..... 439/188, 439/346; 200/51.09
See application file for complete search history.

(56) References Cited

U.S. PATENT DOCUMENTS 2,735,906 A * 2/1956 Avrunin ..... 200/51.09
5,551,884 A * 9/1996 Burkhart, Sr. ..... 439/140
7,641,489 B1 * 1/2010 Hsu et al. ..... 439/188

* cited by examiner

*Primary Examiner* — Phuong K Dinh
(74) *Attorney, Agent, or Firm* — Cheng-Ju Chiang

(57) ABSTRACT

A latchable power outlet with greater ease is disclosed, comprising: a base; at least two electrically conductive plates on the base, wherein the at least two electrically conductive plates are employed for making connection with a power supply and electrically conductive tongs; a two-stage self-locking switch structure on the base; a movable frame connected to the two-stage self-locking switch structure, pressing the two-stage self-locking switch structure after being directly or indirectly pressed by the plug; and at least two electrically conductive tongs; wherein the at least two electrically conductive tongs are connected to the at least two electrically conductive plates and clamp the contact prongs of the plug while being pressed by the movable frame, and wherein the at least two electrically conductive tongs release the contact prongs of the plug and are disconnected from the at least two electrically conductive plates while returning to original position.

15 Claims, 11 Drawing Sheets

LATCHABLE POWER OUTLET

FIELD OF THE INVENTION

The present invention generally relates to a power outlet, and more particularly to a latchable power outlet.

BACKGROUND OF THE INVENTION

In view of safety concerns, most conventional power outlets are equipped with safety switches for making/opening the circuit or protection covers for avoiding a danger of mistakenly touching. However, such improvements adversely affect ease of use.

Referring to FIG. 1, a conventional power outlet 1 and a plug 2 are illustrated. The power outlet 1 includes at least two female contacts 11 and at least two slots 12. The plug 2 includes a base 21 and at least two contact prongs 22. Typically, users hold the base 21 of a plug 2, overcoming friction forces between the female contacts 11 and contact prongs 22 of the plug 2 and elastic forces from the female contacts 11 as inserting contact prongs 22 into the female contacts 11.

Similarly, users hold the base 21 thereof and overcome friction forces between the female contacts 11 and contact prongs 22 of the plug 2, and then the plug 2 is removed from the power outlet 1. If the power outlet 1 is movable rather than being embedded in the wall or table, users have to hold the power outlet 1 using one hand and remove the plug 2 therefrom using the other hand. This leads to inconvenience of use.

Furthermore, because the female contacts 11 of the power outlet 1 are permanently connected to the power supply, such that electric shock may easily occur when contacting with electrically conductive objects.

Accordingly, an improved power outlet with greater ease and safety of insertion is still desirable.

SUMMARY OF THE INVENTION

To overcome the aforementioned drawbacks, embodiments of the invention disclose a latchable power outlet with greater ease, convenience and safety of use.

In one embodiment of the invention, a power outlet is disclosed. The power outlet comprises a base, at least two electrically conductive plates on the base, a two-stage self-locking switch structure on the base, a movable upper cover having at least two slots, a movable frame connected to the two-stage self-locking switch structure, and at least two electrically conductive tongs. The at least two electrically conductive plates are employed for making connection with a power supply and electrically conductive tongs. The at least two slots are used for receiving contact prongs of a plug inserted. The movable frame presses the two-stage self-locking switch structure after being directly or indirectly pressed by the plug. The at least two electrically conductive tongs are connected to the at least two electrically conductive plates and clamp the contact prongs of the plug while being pressed by the movable frame. Furthermore, the at least two electrically conductive tongs release the contact prongs of the plug and are disconnected from the at least two electrically conductive plates while returning to original position along with the movable frame.

Preferably, the at least two electrically conductive tongs are directly attached to the movable frame, capable of being connected to the at least two electrically conductive plates on the base and clamping the contact prongs of the plug after moving together with the movable frame.

Preferably, the at least two electrically conductive tongs are bent by the at least two electrically conductive plates after being connected thereto, thereby clamping the contact prongs of the plug inserted.

Preferably, the power outlet further comprises an extendable pole including a spring disposed between the movable upper cover and the base. The movable upper cover and the base contact tightly after insertion of the contact prongs of the plug into the power outlet.

Preferably, the extendable pole has a ring-shaped protruding portion on its outer surface.

Preferably, the movable upper cover incorporates with the movable frame, and are directly connected to the two-stage self-locking switch structure, so that the at least two electrically conductive tongs move together with the movable upper cover after being pressed by a base of the plug. Preferably, the power outlet further comprises an elastic member serving as a stopping member and disposed on a path through which the inserted contact prongs of the plug pass. The stopping member prevents the movable frame from being moved before insertion of the contact prongs of the plug into the power outlet. The stopping member is directly or indirectly pushed away after insertion of the contact prongs of the plug into the power outlet, thereby allowing the movable frame to be moved. The stopping member is brought back to its original position by the spring after removal of the contact prongs of the plug from the power outlet, preventing the movable frame from being moved again.

Preferably, each path through which the inserted contact prongs of the plug pass is equipped with the elastic member, and each elastic member is simultaneously pushed away by the inserted contact prongs of the plug, thereby allowing the movable frame to be moved.

Preferably, each contact prong of the plug inserted is clamped by an electrically conductive tong in a single direction or at least two electrically conductive tongs in various directions.

Preferably, the movable upper has slots or circular openings for receiving thin-rectangular or circular-cylindrical contact prongs.

Preferably, the at least two electrically conductive tongs are thin-rectangular or arc, being suitable for thin-rectangular or circular-cylindrical contact prongs.

Preferably, the at least two electrically conductive tongs possess protruding portions for clamping the contact prongs having circular openings.

Preferably, the movable upper has two or more openings for corresponding electrically conductive tongs and electrically conductive plates, being capable of receiving various plugs.

DETAILED DESCRIPTION OF THE INVENTION

The present invention may best be understood by reference to the following description in conjunction with the accompanying drawings.

Figure 1:
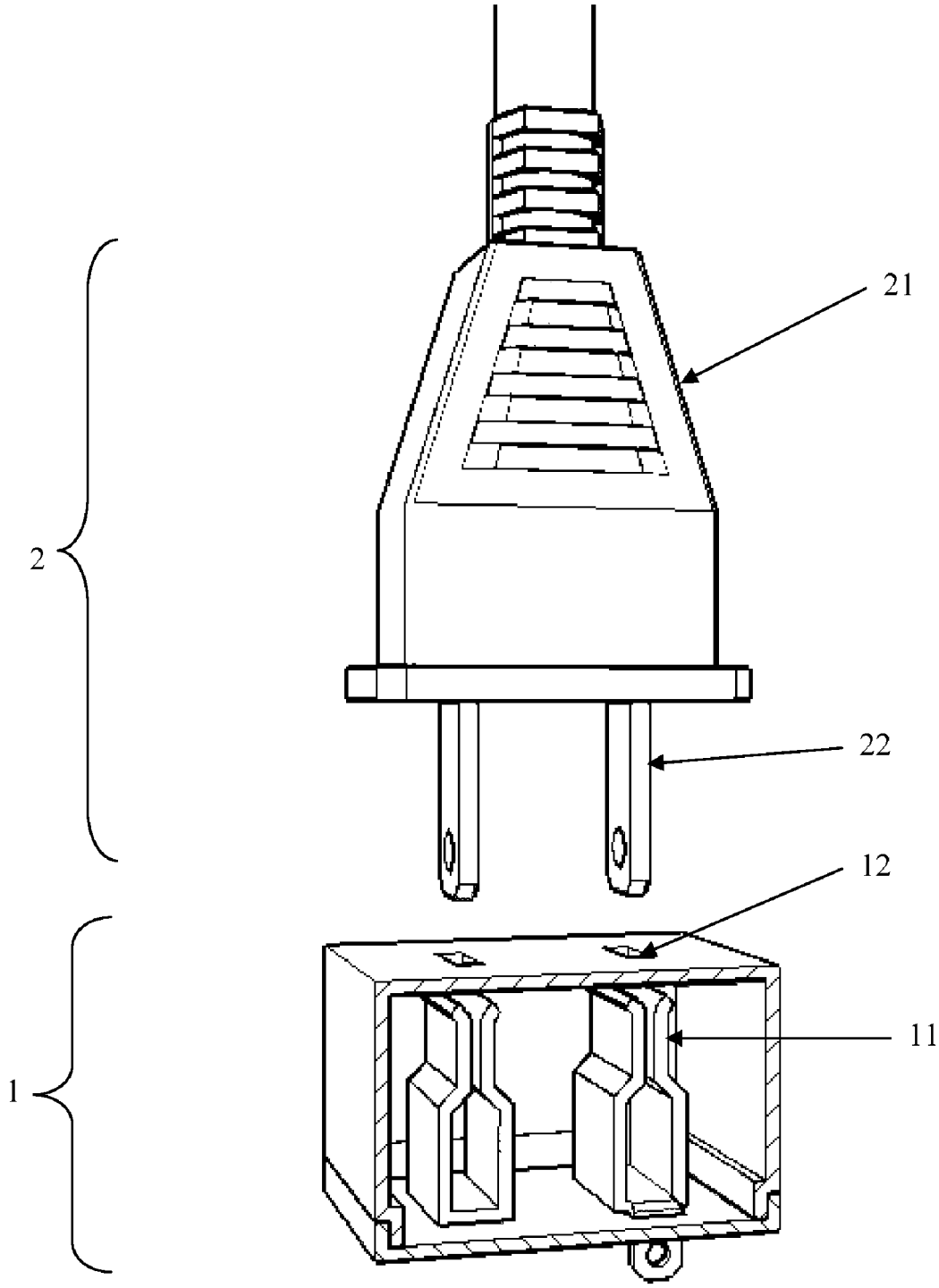
FIG. 1 (PRIOR ART)
FIG. 1 is an isometric view illustrating a conventional power outlet in which a side cover is omitted for clarity.
Figure 2:
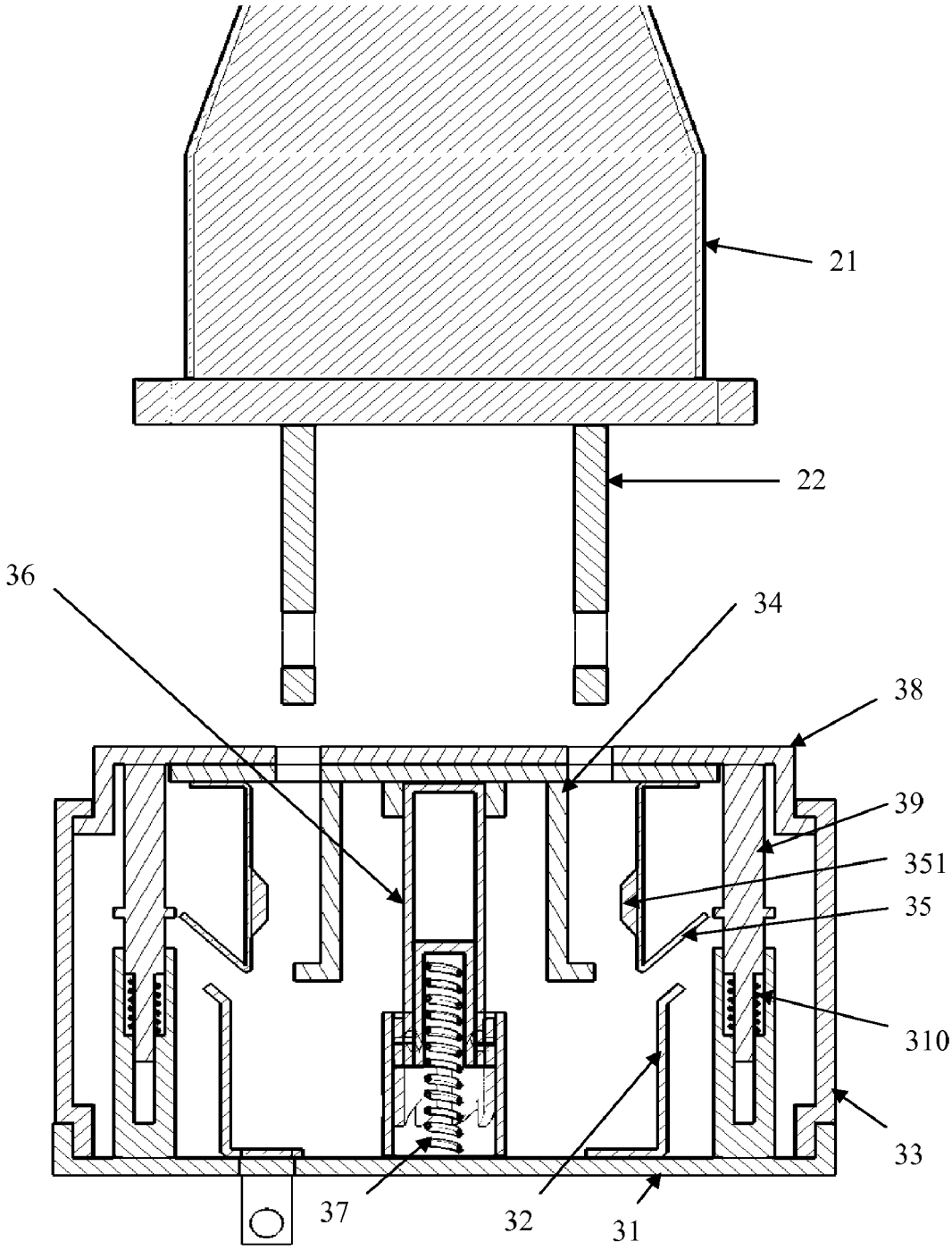
FIG. 2 is a cross-sectional view illustrating a first embodiment of the invention.
Figure 3:
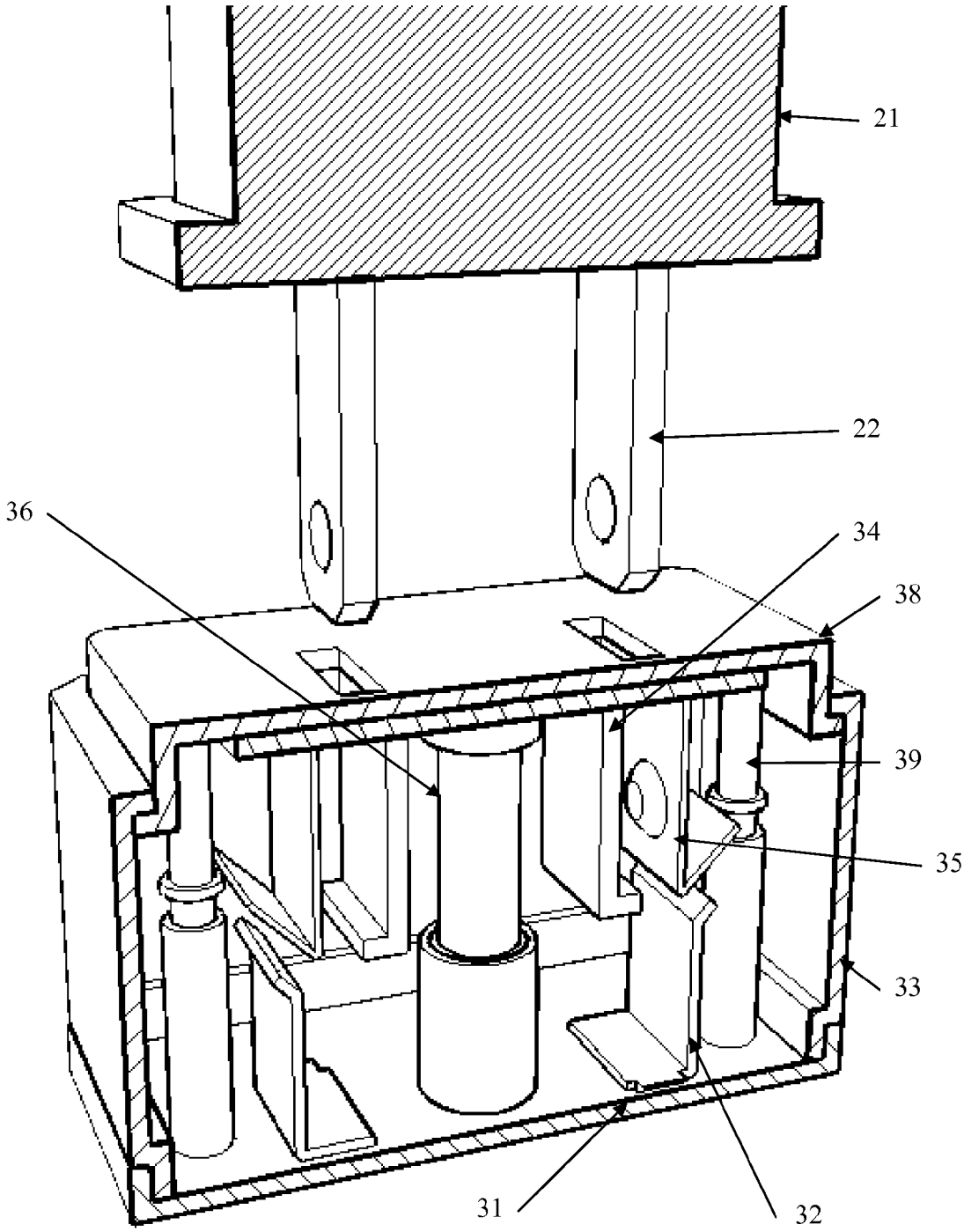
FIG. 3 is a sectional axonometric drawing of a first embodiment of the invention.
Figure 4:
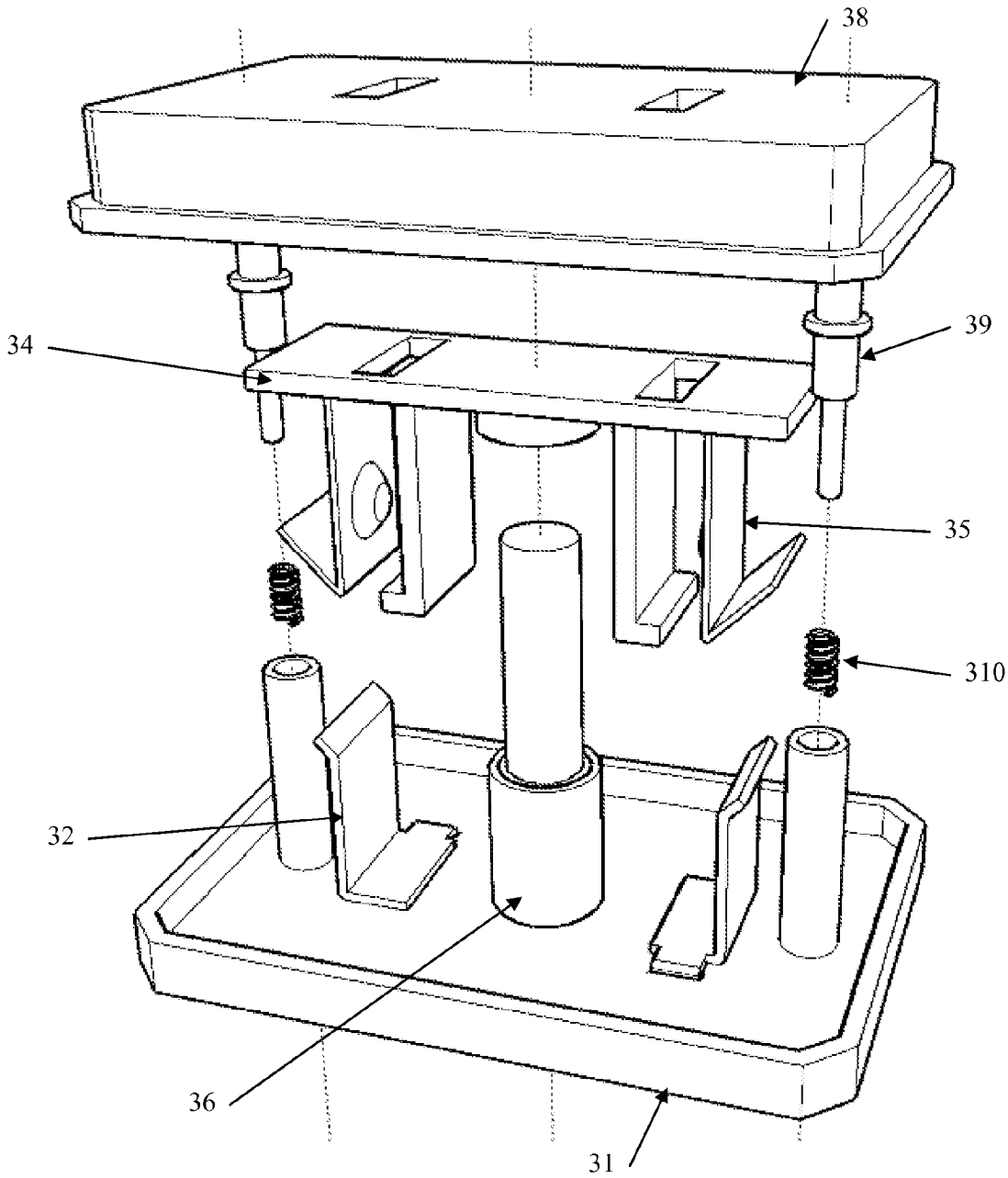
FIG. 4 is an exploded view illustrating a first embodiment of the invention in which a side cover is omitted.

FIGS. 2-6 illustrate a first embodiment of the invention. As shown in FIGS. 2-4, a power outlet 3 and a plug 2 are illustrated. The power outlet 3 includes a base 31, two electrically conductive plates 32 attached to the base 31, a side cover 33, a movable frame 34, two electrically conductive tongs 35 attached to the movable frame 34 and comprising a beveled free end for each of them, a two-stage self-locking switch structure 36 arranged between the base 31 and the movable frame 34, and extendable poles 39 serving as a stopping member for security purposes. The plug 2 includes a plug base 21 and at least two contact prongs 22. In this embodiment, the two-stage self-locking switch structure 36 is similar to that used in pens, remaining compressed after being pressed while resuming to its original status after being pressed again. More exemplary mechanism performing similar to the switch structure 36 can be referred to the "heart-shaped cam" of U.S. Pat. No. 4,367,383 for details.

Figure 5:
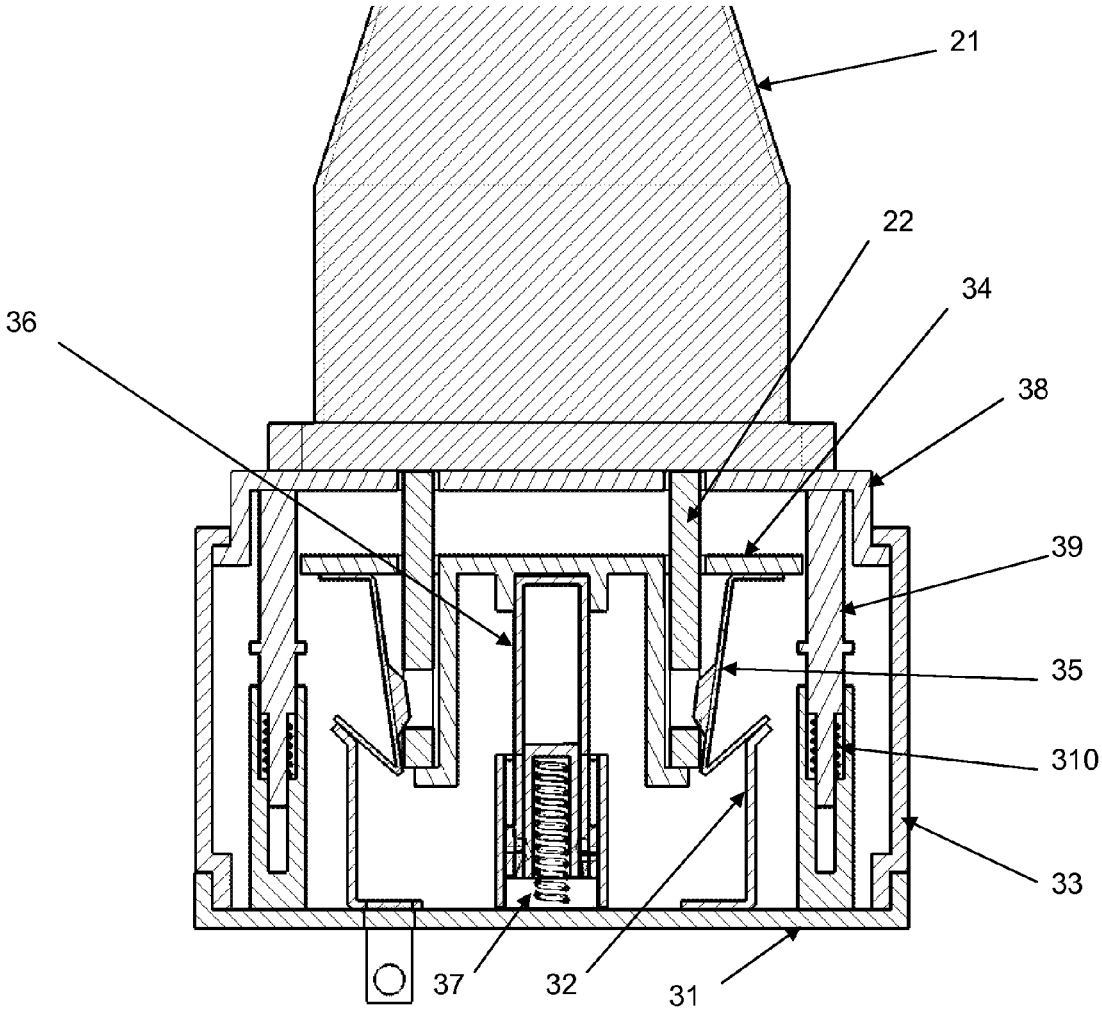
FIG. 5 is a cross-sectional view illustrating a first embodiment of the invention in which a plug has been inserted and a two-stage self-locking switch remains pressed.

Referring to FIG. 2 and FIG. 5, users hold the plug base 21 and insert contact prongs 22 of the plug 2 into the power outlet 3. During the insertion of the plug 2 into the power outlet 3, the movable frame 34 is pressed via the contact prongs 22 of the plug 2 towards the electrically conductive plates 32, and overcome elastic forces from the spring 37 within the two-stage self-locking switch structure 36. As such, the movable frame 34 moves downward and brings the electrically conductive tongs 35 to contact the electrically conductive plates 32 on the base, thereby making a circuit. In the meantime, the electrically conductive tongs 35 laterally clamp the contact prongs 22 of the plug 2. The electrically conductive tongs 35 may include protruding portions 351 for clamping the contact prongs 22 having circular openings. The electrically conductive tongs 35 may be arc shaped, such that they can clamp circular-cylindrical contact prongs 22.

After the movable frame 34 is pressed, the two-stage self-locking switch structure 36 within the power outlet then stably maintain the movable frame 34 at its pressed position, preventing the movable frame 34 from returning to its original position via the elastic of the spring 37. Furthermore, the electrically conductive tongs 35 clamp the contact prongs 22 of the plug. Accordingly, the electrically conductive plates 32 continuously supply power to the contact prongs 22 of the plug through the electrically conductive tongs 35. After being pressed, the two-stage self-locking switch structure 36 may move back slightly before stably remaining at its pressed position. As such, extendable poles 39 including springs 310 force the upper cover 38 to be tightly attached to the plug base 21.

Once the two-stage self-locking switch structure 36 is pressed and released by users again, it will resume to the original status via the spring 37, lifting the movable frame 34. In the meantime, the electrically conductive tongs 35 disconnects from the electrically conductive plates 32, thereby breaking the circuit. The electrically conductive tongs 35 simultaneously release the contact prongs 22 of the plug. In doing so, users can remove the plug from the power outlet easily without overcoming the friction forces between the electrically conductive tongs 35 and the contact prongs 22.

Figure 6:
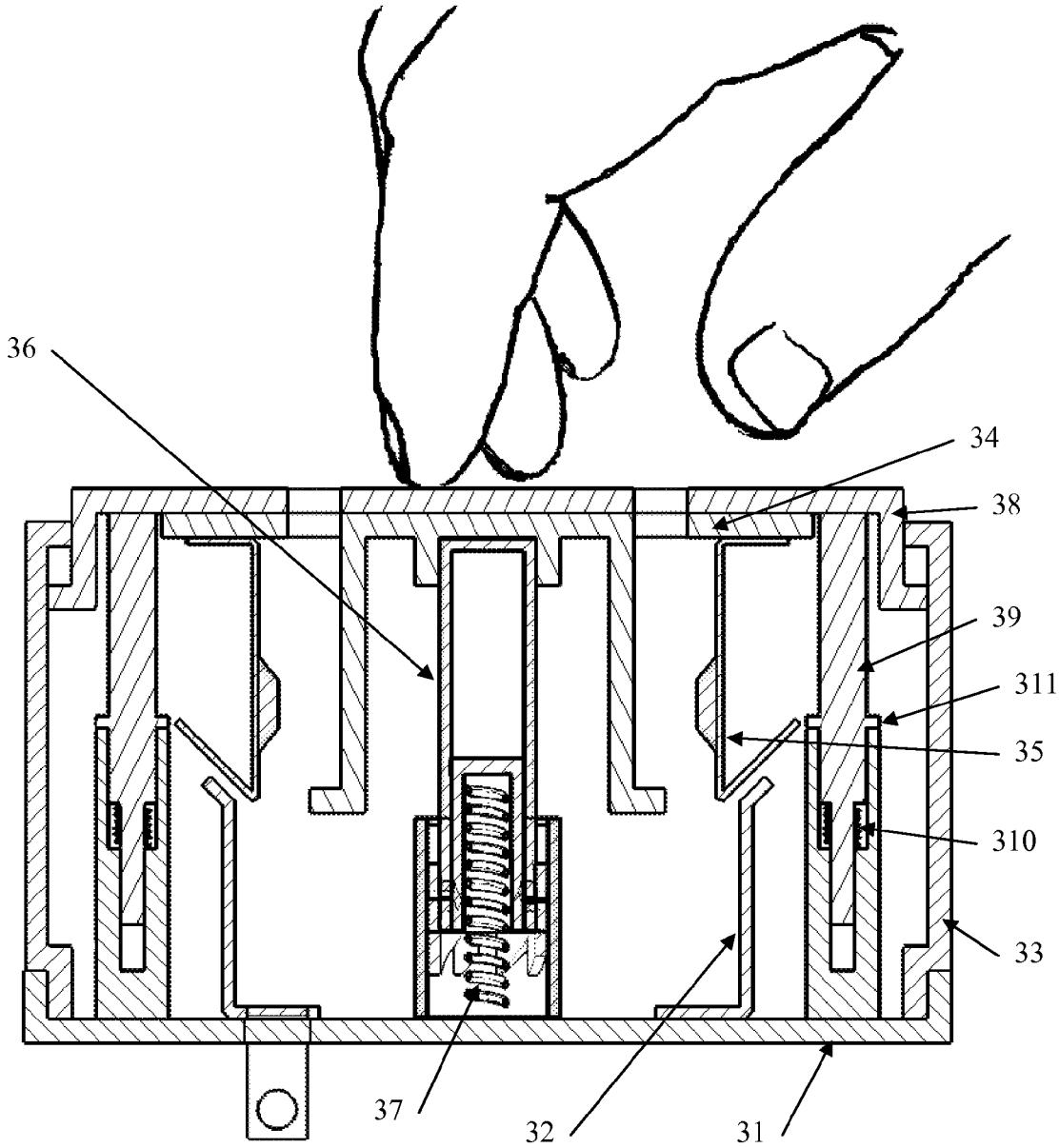
FIG. 6 is another cross-sectional view of a first embodiment of the present invention, showing that two extendable poles prevent the electrically conductive tongs from being connected to the electrically conductive plates when users press the upper cover.

Referring to FIG. 2 and FIG. 3, when the power outlet is not in use, the electrically conductive tongs 35 is isolated from the electrically conductive plates 32. Therefore, electric shock can be prevented even if the movable frame 34 contacts with electrically conductive objects, e.g. paper clips, into the power outlet. As shown in FIG. 6, the extendable pole 39 has a ring-shaped protruding portion 311 on its outer surface and is attached to the upper cover 38. When children directly press the upper cover 38 outside, the ring-shaped protruding portion 311 prevents the upper cover from being continuously pressed. As a result, the electrically conductive tongs 35 attached to the movable frame disconnects from the electrically conductive plates 32 on the base, opening the circuit.

Figure 7:
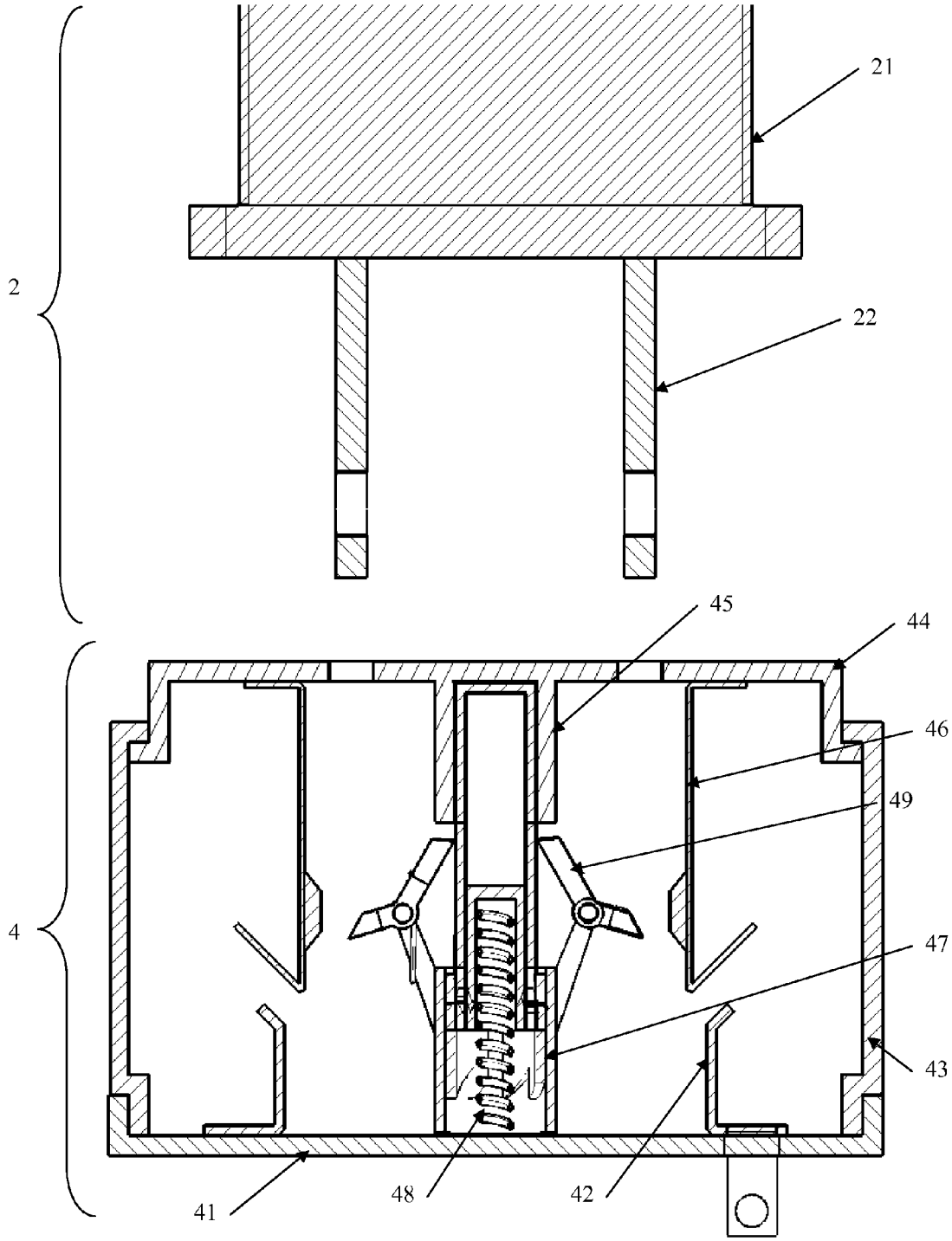
FIG. 7 is a cross-sectional view of a second embodiment of the present invention.
Figure 8:
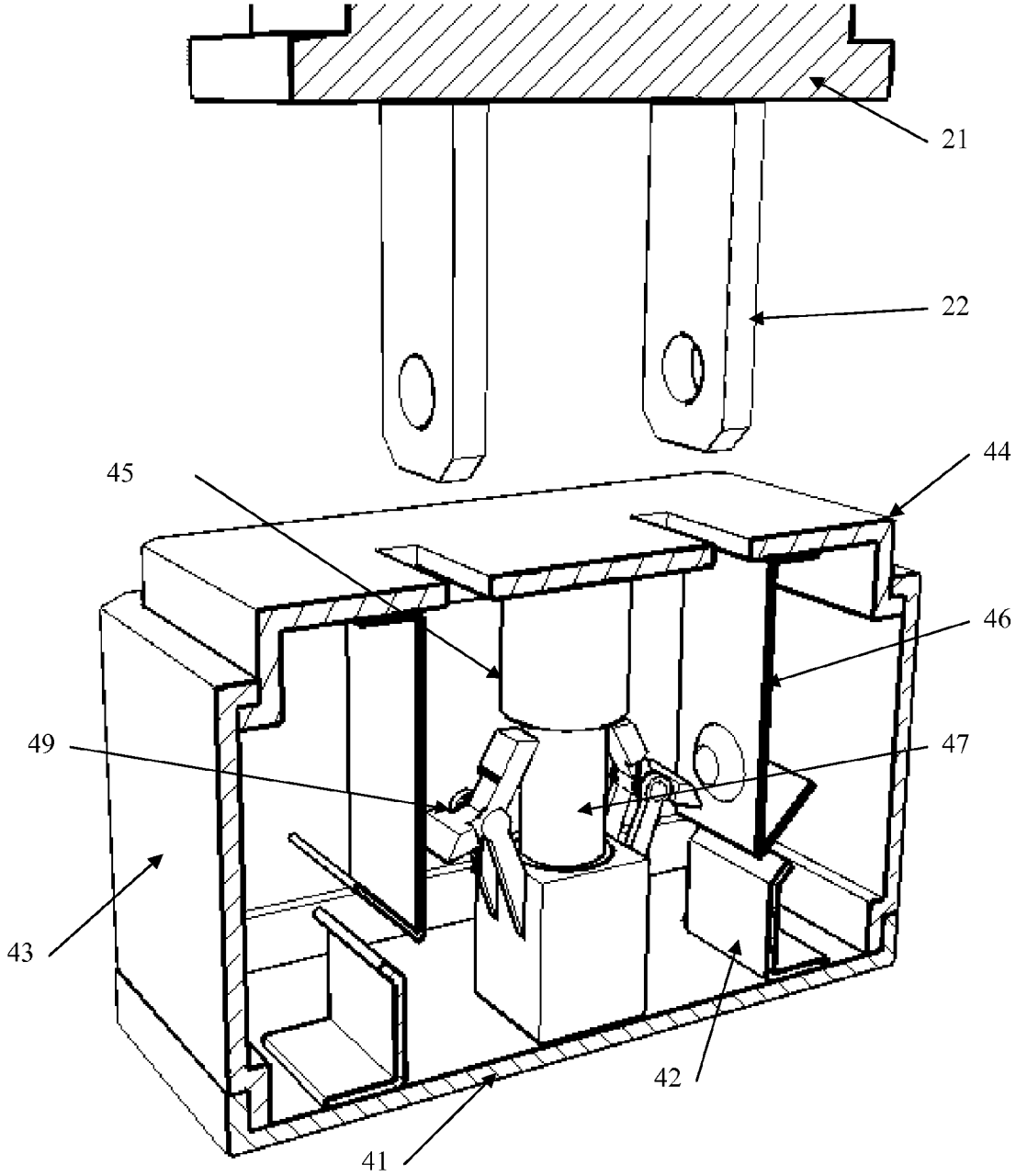
FIG. 8 is a sectional axonometric drawing of a second embodiment of the invention.
Figure 9:
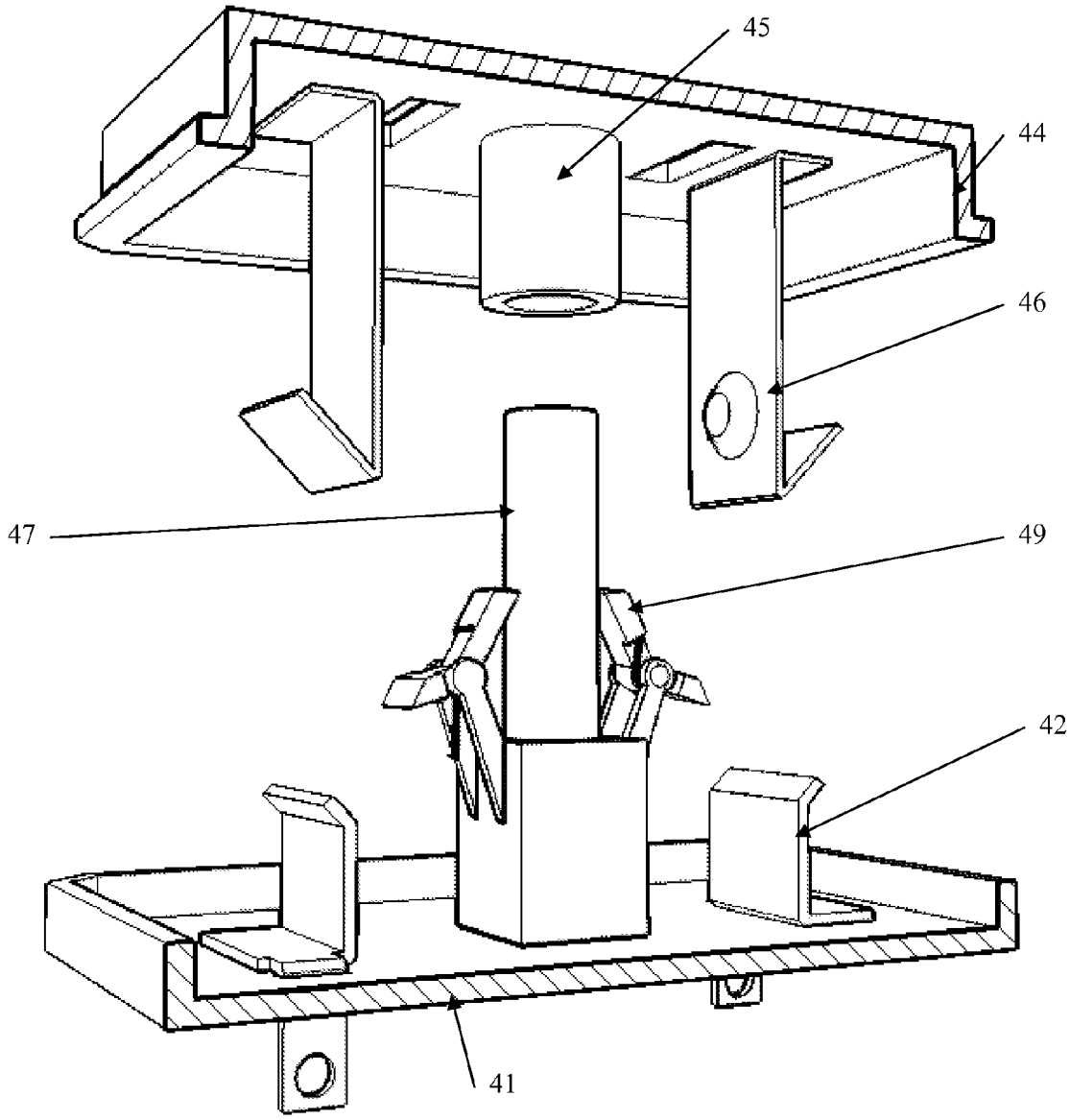
FIG. 9 is an exploded view illustrating a second embodiment of the invention in which a side cover is omitted, specifically showing a cross-sectional view of a movable frame and a base.

FIGS. 7-11 illustrate a second embodiment of the invention. As shown in FIGS. 7-9, a power outlet 4 and a plug 2 are illustrated. The power outlet 4 includes a base 41, two electrically conductive plates 42 attached to the base 41, a side cover 43, a movable frame 44, two electrically conductive tongs 46 attached to the movable frame 44 and comprising a beveled free end for each of them, a two-stage self-locking switch structure 47, which works and performs same as the switch structure 36 of the first embodiment, disposed between the base 41 and the movable frame 44, and two elastic members 49 serving as a stopping member for security purposes and each of them comprising two forked free ends for respective engagements with the frame 44 and the plug 2. The engagement of one forked free end of the elastic members 49 with the frame 44 can stop movement of the frame 44. The plug 2 includes a plug base 21 and at least two contact prongs 22.

As shown in FIG. 7 and FIG. 8, before insertion of the contact prongs 22 of the plug, the elastic members 49 is attached to an extending portion 45 of the movable frame 44, preventing the movable frame 44 from being freely pressed. Accordingly, the electrically conductive tongs 46 cannot be connected to the electrically conductive plates 42. This will not make the circuit.

Figure 10:
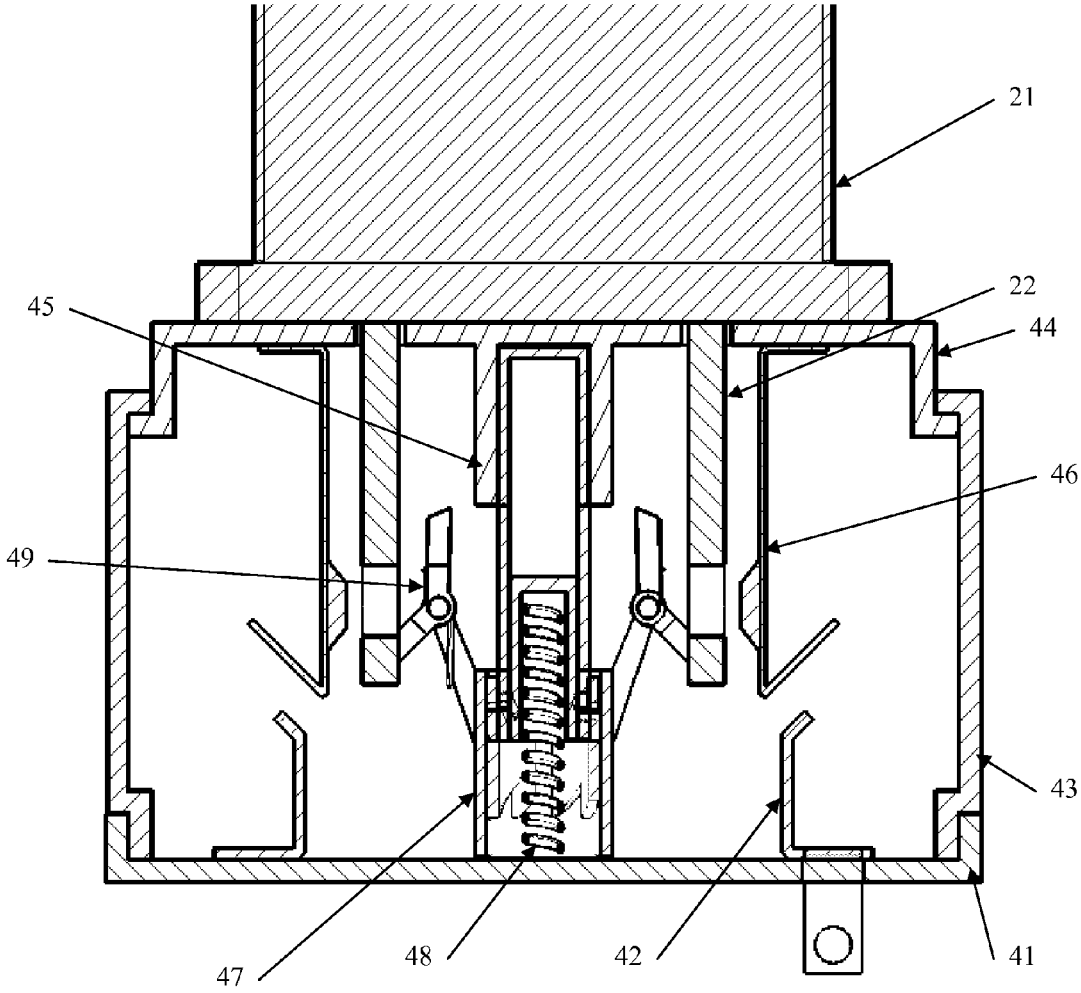
FIG. 10 is a cross-sectional view illustrating a second embodiment of the invention in which a plug has been inserted to push the elastic members away and is ready for pressing the two-stage self-locking switch.
Figure 11:
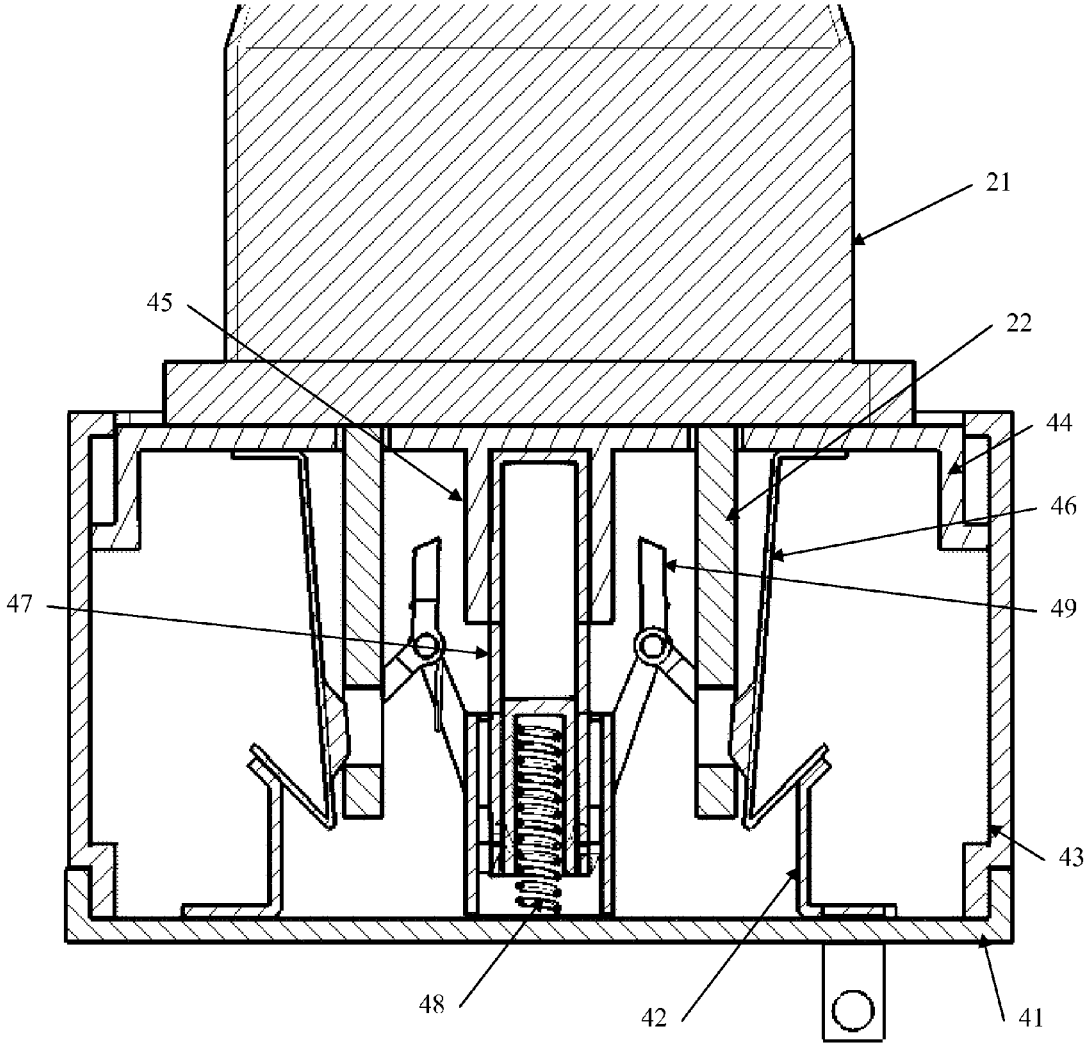
FIG. 11 is a cross-sectional view illustrating a second embodiment of the invention in which a plug has been inserted and a two-stage self-locking switch remains pressed.

As shown in FIG. 10 and FIG. 11, when the contact prongs 22 of the plug are inserted, they will simultaneously push the elastic members 49 away such that the upper cover can move downward. As shown in FIG. 11, users keep continuously pressing the plug downward and compressing the spring 48 within the two-stage self-locking switch structure 47 until that the electrically conductive tongs 46 are connected to the electrically conductive plates 42 on the base and laterally clamp the contact prongs 22 of the plug 2. As a result, the two-stage self-locking switch structure 47 within the power outlet can remain pressed without returning to the original position even users stop pressing. Furthermore, the electrically conductive plates 42 on the base are capable of continuously supplying power to the contact prongs 22 of the plug 2 via the electrically conductive tongs 46.

In this embodiment, the power outlet features that users have to push the elastic members 49 away simultaneously using the contact prongs 22 of the plug to press the movable frame 44. That is, even though one of the elastic members 49 is push away due to insertion of undesired objects through one slot of the power outlet, the other elastic member 49 can still prevent the upper from being pressed.

The two-stage self-locking switch structure 47 will resume to its original status when users press and release it again. In such a condition, the two-stage self-locking switch structure 47 will raise the movable frame 44, resulting in that the electrically conductive tongs 46 disconnect from the electrically conductive plates 42 on the base 41 and release the contact prongs 22 of the plug. Finally, the plug can be removed from the power outlet easily.

As described in the aforementioned embodiments, the power outlet clamps the plug when inserted into and slightly press the power outlet. The power outlet releases the plug when the power outlet is pressed again. As such, no flow of electric current occurs in the electrically conductive tongs when the power outlet is not in use.

In other embodiments, the power outlet may be a two-prong power outlet, a three-prong power outlet, a US standard power outlet, a European standard power outlet, a wall power outlet, or an independent power outlet.

As mentioned above, the power outlet of the invention provides ease and convenience in use.

Although specific embodiments have been illustrated and described, it will be obvious to those skilled in the art that various modifications may be made without departing from what is intended to be limited solely by the appended claims.

What is claimed is:

1. A latchable power outlet used to electrically connect with a power supply and a plug respectively so as to transmit power from the power supply to the plug, comprising:

a base, comprising at least two electrically conductive plates formed thereon and electrically connected to the power supply;

a frame installed and movably supported beside the base so as to be movable relative to the base, the plug situated beside the frame and allowing contact prongs of the plug to move and extend through the frame respectively toward the base; and at least two electrically conductive tongs attached to the frame and movable relative to the base together with the frame, the at least two tongs being capable of further electrically connecting with the power supply via engagement thereof with corresponding ones of the at least two plates for transmitting the power from the power supply, each of the at least two tongs spacing and electrically disengaging from a corresponding one of the contact prongs in the event of the contact prongs moving between the base and the frame, and electrically engaged with the corresponding one of the contact prongs in the event of the contact prongs completing movement thereof between the base and the frame, and said each of the at least two tongs being forced to move toward the corresponding one of the contact prongs for electrical connection therewith due to engagement between said each of the at least two tongs and the corresponding ones of the at least two plates.

2. The latchable power outlet of claim 1, wherein said each of the at least two tongs comprises a beveled free end used for the engagement between said each of the at least two tongs and the corresponding ones of the at least two plates so as to facilitate movement of said each of the at least two tongs toward the corresponding one of the contact prongs.

3. The latchable power outlet of claim 1, wherein a stopping member is installed between the frame and the base to prevent the at least two tongs from electrically connecting with the power supply without the plug, the stopping member is located right between two of the contact prongs when the two of the contact prongs are located to move between the base and the frame.

4. The latchable power outlet of claim 1, wherein said each of the at least two tongs is moved to electrically connect with the corresponding one of the contact prongs at a side thereof which faces away from a central axis of the plug.

5. The latchable power outlet of claim 3, wherein the stopping member comprises two forked free ends, one of the free ends extends to engage with the corresponding one of the contact prongs and the other of the free ends extends to engage with the frame so as to stop movement of the frame.

6. A latchable power outlet, comprising:

a base;

at least two electrically conductive plates installed on the base to electrically connect with a power supply, two of the at least two conductive plates spacing from each other for a first distance;

a movable frame installed next to the base to be movable relative to the base by push of a plug and embrace the at least two conductive plates between the base and the frame, contact prongs of the plug capable of extending through the movable frame to be located between the frame and the base, two of the contact prongs corresponding to the two of the at least two conductive plates spacing from each other for a second distance smaller than the first distance; and at least two electrically conductive tongs installed to the frame to move together therewith and to face the at least two conductive plates, two of the at least two tongs corresponding to the two of the at least two conductive plates spacing from each other in a third distance larger than the second distance, said two of the at least two tongs moving toward said two of the contact prongs for electrical connection with said two of the contact prongs due to engagement thereof with said two of the at least two conductive plates when the plug pushes the frame and said two of the at least two tongs toward the base to engage with said two of the at least two conductive plates.

7. The latchable power outlet of claim 6, further comprising a switch structure installed on the base for retaining the frame and the at least two tongs at a position where said two of the at least two tongs electrically and respectively connect with said two of the contact prongs of the plug, and for releasing the frame and the at least two tongs when any push from the plug is applied onto the frame after the frame is retained by the switch structure.

8. The latchable power outlet of claim 6, wherein each of said two of the at least two electrically conductive tongs comprises a beveled free end used for the engagement with said two of the at least two electrically conductive plates.

9. The latchable power outlet of claim 6, further comprising a stopping member disposed between the frame and the base to prevent the at least two tongs from electrically connecting with the at least two conductive plates without the plug.

10. The latchable power outlet of claim 9, wherein the stopping member comprises at least one elastic member, and each of the at least one elastic member is pushed away by the contact prongs of the plug when the plug presses on the frame and the contact prongs thereof extend through the frame, thereby allowing the movable frame to be moved.

11. The latchable power outlet of claim 6, wherein the at least two electrically conductive tongs are thin-rectangular or arc so as to be suitable for thin-rectangular or circular-cylindrical contact prongs of the plug.

12. The latchable power outlet of claim 6, wherein the at least two electrically conductive tongs possess protruding portions for electrically engaging with the contact prongs having circular openings.

13. The latchable power outlet of claim 9, wherein the stopping member comprises two forked free ends, one of the free ends extends to engage with a corresponding one of the contact prongs and the other of the free ends extends to engage with the frame so as to stop movement of the frame.

14. The latchable power outlet of claim 9, wherein the stopping member is located right between said two of the contact prongs when said two of the contact prongs extend between the frame and the base.

15. The latchable power outlet of claim 6, wherein each of said two of the at least two electrically conductive tongs is moved to electrically connect with a corresponding one of said two of the contact prongs at a side thereof which faces away from a central axis of the plug.

* * * * *